US007952552B2

(12) United States Patent
Kong et al.

(10) Patent No.: US 7,952,552 B2
(45) Date of Patent: May 31, 2011

(54) APPARATUS AND METHOD FOR DRIVING LIQUID CRYSTAL DISPLAY DEVICE

(75) Inventors: Nam Yong Kong, Seongnam-si (KR); Tae Ho You, Incheon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 12/815,962

(22) Filed: Jun. 15, 2010

(65) Prior Publication Data

US 2010/0315448 A1 Dec. 16, 2010

Related U.S. Application Data

(62) Division of application No. 11/476,255, filed on Jun. 27, 2006, now Pat. No. 7,859,497.

(30) Foreign Application Priority Data

Sep. 12, 2005 (KR) ..... 10-2005-0084577

(51) Int. Cl.
*G09G 3/36* (2006.01)

(52) U.S. Cl. ..... 345/94; 345/99

(58) Field of Classification Search ..... 345/87, 345/88, 94, 95, 99, 100, 103
See application file for complete search history.

(56) References Cited

U.S. PATENT DOCUMENTS 5,828,415 A 10/1998 Keating et al.
7,023,918 B2 4/2006 Yu et al.
7,348,951 B2 3/2008 Aoki
7,786,967 B2 * 8/2010 Kim et al. ..... 345/89
2003/0058264 A1 3/2003 Takako
2005/0078069 A1 4/2005 Aiba
2005/0156852 A1 7/2005 Kwon
2006/0007197 A1 * 1/2006 Gilbert ..... 345/204

FOREIGN PATENT DOCUMENTS

EP 0 657 860 A2 6/1995
EP 1 494 196 A2 1/2005
EP 1 521 237 A2 4/2005

(Continued)

OTHER PUBLICATIONS

Office Action issued in corresponding German Patent Application No. 10 2006 029 710.5; issued Sep. 22, 2009.

(Continued)

*Primary Examiner* — Ricardo L Osorio
(74) *Attorney, Agent, or Firm* — Brinks Hofer Gilson & Lione

(57) ABSTRACT

An apparatus and method for driving an LCD device is provided. The apparatus for driving an LCD device comprises an image display unit that includes liquid crystal cells formed in each region defined by a plurality of gate lines and a plurality of data lines. A data driver supplies analog video signals to the respective data lines. A gate driver supplies scan pulses to the respective gate lines. A data converter detects motion vectors from input data and generating modulated data by filtering the input data in accordance with the motion vectors to generate overshoot or undershoot in a boundary along a motion direction. A timing controller aligns the modulated data to supply the aligned data to the data driver and operates the data driver and the gate driver.

26 Claims, 17 Drawing Sheets

FOREIGN PATENT DOCUMENTS

| | | |
|---|---|---|
| JP | 04-213973 | 8/1992 |
| JP | 2000-330501 | 11/2000 |
| JP | 2001-042831 | 2/2001 |
| JP | 2002-191055 | 7/2002 |
| JP | 2003-050574 | 2/2003 |
| JP | 2004-233949 | 8/2004 |
| JP | 2005-043864 | 2/2005 |
| JP | 2005-148521 | 6/2005 |
| JP | 2005-196108 | 7/2005 |
| WO | 2005/043498 A2 | 5/2005 |

OTHER PUBLICATIONS

Office Action issued in corresponding Japanese Patent Application No. 2006-176285; issued Jan. 5, 2010.

* cited by examiner

APPARATUS AND METHOD FOR DRIVING LIQUID CRYSTAL DISPLAY DEVICE

The present patent document is a divisional of U.S. patent application Ser. No. 11/476,255, filed Jun. 27, 2006, which claims priority to Korean Patent Application No. P2005-084577 filed in Korea on Sep. 12, 2005, which is hereby incorporated by reference.

BACKGROUND

1. Field of the Invention

An apparatus and method for driving a liquid crystal display (LCD) device is provided.

2. Discussion of the Related Art

Generally, a LCD device can adjust the light transmittance of liquid crystal cells according to a video signal so that an image is displayed. An active matrix type LCD device has a switching element formed for every liquid crystal cell and can display a moving image. A thin film transistor (TFT) can be used as a switching element in the active matrix type LCD device.

FIG. 1 illustrates a related art apparatus for driving an LCD device.

As shown in FIG. 1, the related art apparatus for driving an LCD includes an image display unit 2 including liquid crystal cells formed in each region defined by the first to n-th gate lines GL1 to GLn and the first to m-th data lines DL1 to DLm. A data driver 4 supplys analog video signals to the data lines DL1 to DLm. A gate driver 6 supplys scan pulses to the gate lines GL1 to GLn. A timing controller 8 aligns externally input data RGB and supplies them to the data driver 4, generates data control signals DCS that control the data driver 4, and generates gate control signals GCS to control the gate driver 6.

The image display unit 2 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area prepared by the spacer.

The image display unit 2 includes a TFT formed in the region defined by the gate lines GL1 to GLn and the data lines DL1 to DLm, and the liquid crystal cells connected to the TFT. The TFT supplies analog video signals from the data lines DL1 to DLm to the liquid crystal cells in response to the scan pulses from the gate lines GL1 to GLn. The liquid crystal cell is comprised of common electrodes facing each other by interposing the liquid crystal therebetween and pixel electrodes connected to the TFT. Therefore, the liquid crystal cell is equivalent to a liquid crystal capacitor Clc. The liquid crystal cell includes a storage capacitor Cst connected to a previous gate line to maintain the analog video signals filled in the liquid crystal capacitor Clc until the next analog video signals are filled therein.

The timing controller 8 aligns the externally input data RGB to be suitable for driving of the image display unit 2 and supplies the aligned data to the data driver 4. Also, the timing controller 8 generates the data control signals DCS and the gate control signals GCS using a dot clock DCLK, a data enable signal DE, and horizontal and vertical synchronizing signals Hsync and Vsync that are externally input, so as to control each driving timing of the data driver 4 and the gate driver 6.

The gate driver 6 includes a shift register that sequentially generates scan pulses, for example, gate high pulses in response to a gate start pulse GSP and a gate shift clock GSC among the gate control signals GCS from the timing controller. The gate driver 6 sequentially supplies the gate high pulses to the gate lines GL of the image display unit 2 to turn on the TFT connected to the gate lines GL.

The data driver 4 converts the data signal, aligned from the timing controller 8, into analog video signals. This conversion is in response to the data control signals DCS that are supplied from the timing controller 8. The analog video signals, which are supplied to the data lines DL, correspond to one horizontal line per one horizontal period. The scan pulses are supplied into the gate lines GL. In other words, the data driver 4 selects a gamma voltage having a predetermined level depending on a gray level value of the data signal Data and supplies the selected gamma voltage to the data lines DL1 to DLm. The data driver 4 then inverses polarity of the analog video signals supplied to the data lines DL in response to a polarity control signal POL.

The related art apparatus for driving an LCD device has a relatively slow response speed due to characteristics such as the inherent viscosity and elasticity of the liquid crystal. In other words, although the response speed of the liquid crystal may be different according to the physical properties and cell gap of the liquid crystal, it is common that the rising time is 20 to 80 ms and the falling time is 20 to 30 ms. Because this response speed is longer than one frame period (16.67 ms in National Television Standards Committee (NTSC)) of a moving image, as shown in FIG. 2, the response of the liquid crystal proceeds to the next frame before a voltage being charged on the liquid crystal cell reaches a desired level.

Since the image of each frame displayed in the image display unit 2 affects the image of the next frame, as shown in FIG. 3, motion blurring occurs in the moving image due to perception of a viewer.

The related art apparatus and method for driving an LCD device causes motion blurring degradation in contrast ratio, and, in turn, degradation in display quality.

In order to prevent motion blurring from occurring, an over-driving apparatus, which modulates a data signal to obtain the fast response speed of the liquid crystal, has been suggested.

FIG. 4 is a block diagram illustrating a related art over-driving apparatus.

As shown in FIG. 4, the related art over-driving apparatus 50 includes a frame memory 52 that stores data RGB of a current frame Fn, a look-up table 54 that generates modulated data for obtaining the fast response speed of the liquid crystal by comparing the data RGB of the current frame Fn with data of a previous frame Fn−1 stored in the frame memory 52, and a mixing unit 56 that mixes the modulated data from the look-up table 54 with the data RGB of the current frame Fn.

The look-up table 54 lists modulated data that converts a voltage of the data RGB of the current frame Fn into a higher voltage to obtain the fast response speed of the liquid crystal, thereby adapting to a gray level value of an image moving at the fast speed.

Since a voltage higher than an actual data voltage is applied to the liquid crystal using the look-up table 54 as shown in FIG. 5, the fast response speed of the liquid crystal is adapted to a target gray level voltage until a desired gray level value is actually obtained.

Accordingly, the related art over-driving apparatus 50 can reduce motion blurring of a display image by accelerating the response speed of the liquid crystal using the modulated data.

However, the related art LCD device fails to obtain a clear image due to motion blurring occurring in boundaries A and B of each image as shown in FIG. 6 even though the image is displayed using the over-driving apparatus. Since luminance increases between the boundaries A and B of the image to have a tilt, motion blurring still occurs even though the liquid crystal is driven at high speed.

BRIEF SUMMARY

An apparatus and method for driving an LCD device is provided.

An apparatus that drives an LCD device comprises an image display unit that includes liquid crystal cells formed in each region defined by a plurality of gate lines and a plurality of data lines. A data driver supplies analog video signals to the respective data lines. A gate driver supplies scan pulses to the respective gate lines. A data converter detects motion vectors from input data and generates modulated data by filtering the input data in accordance with the motion vectors to generate overshoot or undershoot in a boundary along a motion direction. A timing controller aligns the modulated data and supplies the aligned data to the data driver and controls the data driver and the gate driver.

The data converter generates overshoot if the gray level is changed from low gray level to high gray level in the boundary, and generates undershoot if the gray level is changed from a high gray level to a low gray level in the boundary.

A method for driving an LCD device comprises an image display unit that includes liquid crystal cells formed in each region defined by a plurality of gate lines and a plurality of data lines. The method comprises detecting motion vectors from input data and generating modulated data by filtering the input data in accordance with the motion vectors to generate overshoot or undershoot in a boundary along a motion direction; supplying scan pulses to the respective gate lines; and converting the modulated data into analog video signals to synchronize with the scan pulses and supplying the analog video signals to the respective data lines.

The overshoot is generated if gray level is changed from a low gray level to a high gray level in the boundary, and the undershoot is generated if the gray level is changed from a high gray level to a low gray level in the boundary.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE DRAWINGS AND THE PRESENTLY PREFERRED EMBODIMENTS

Reference will now be made in detail to the preferred embodiments, examples of which are illustrated in the accompanying drawings. Wherever possible, the same reference numbers will be used throughout the drawings to refer to the same or like parts.

Figure 1:
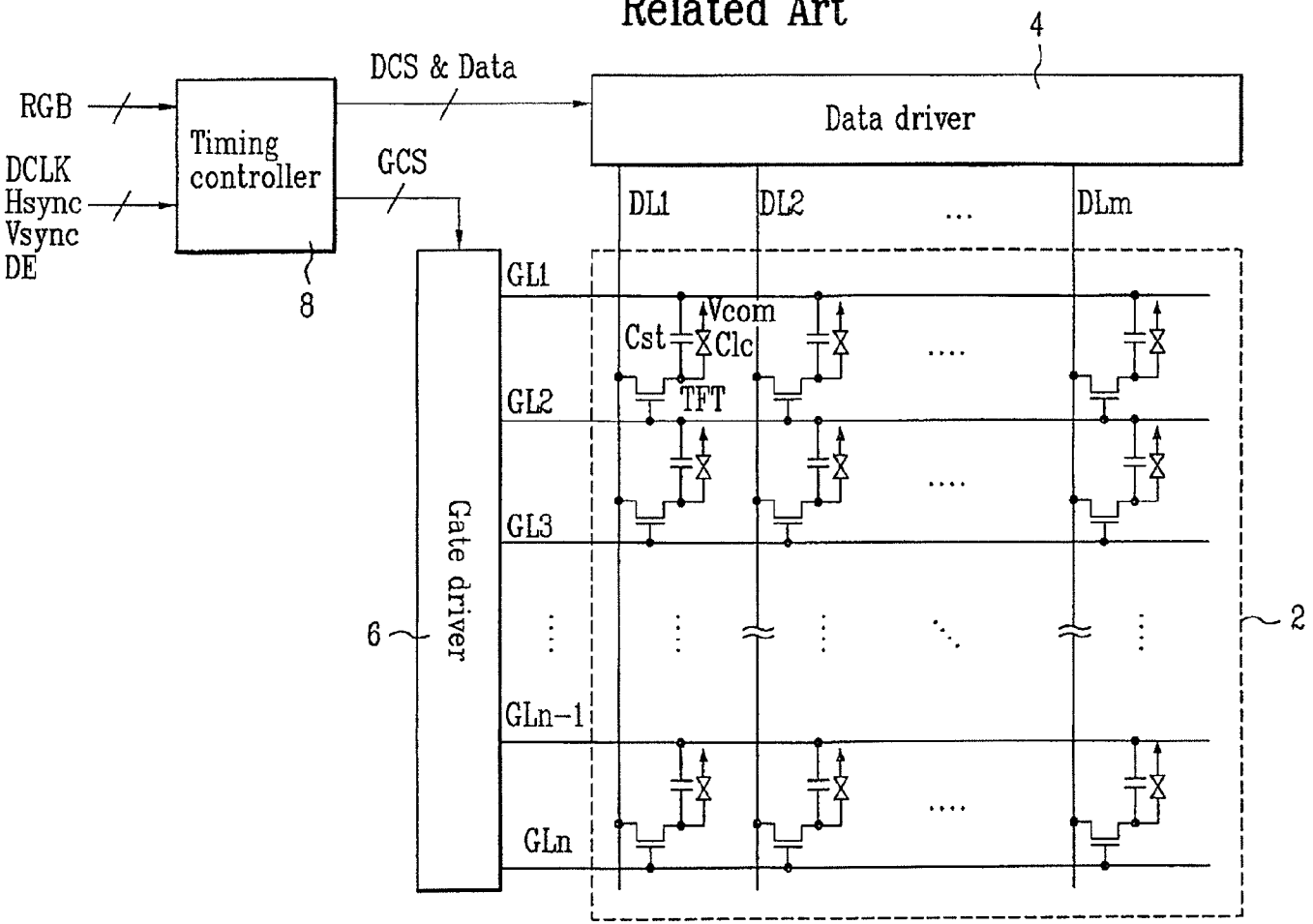
FIG. 1 Related Art
FIG. 1 illustrates a related art apparatus that drives an LCD device.
Figure 2:
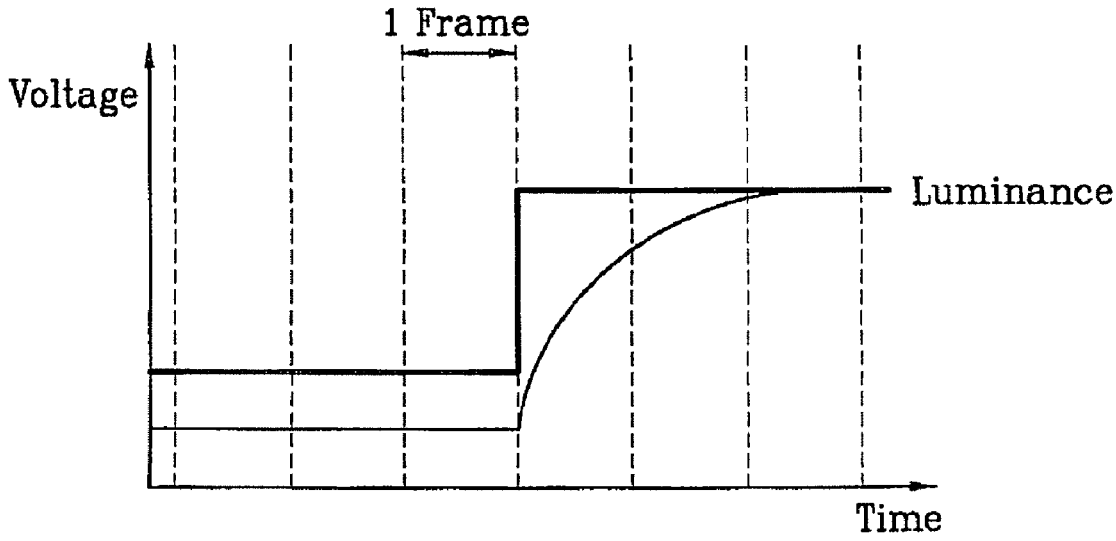
FIG. 2 Related Art
FIG. 2 illustrates the response speed and luminance of a liquid crystal cell shown in FIG. 1.
Figure 3:
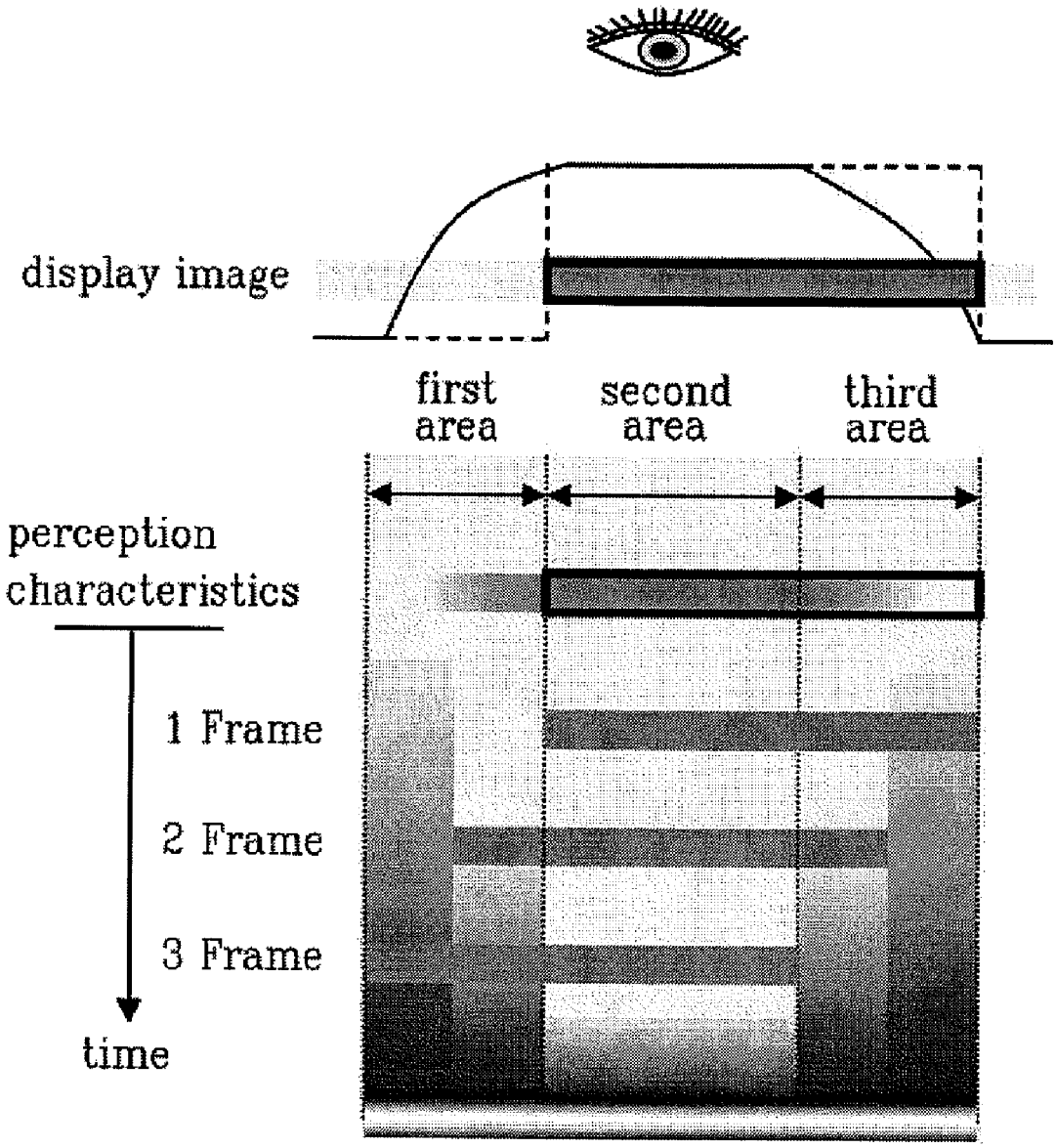
FIG. 3 Related Art
FIG. 3 illustrates motion blurring occurring in a related art apparatus and method for driving an LCD device.
Figure 4:
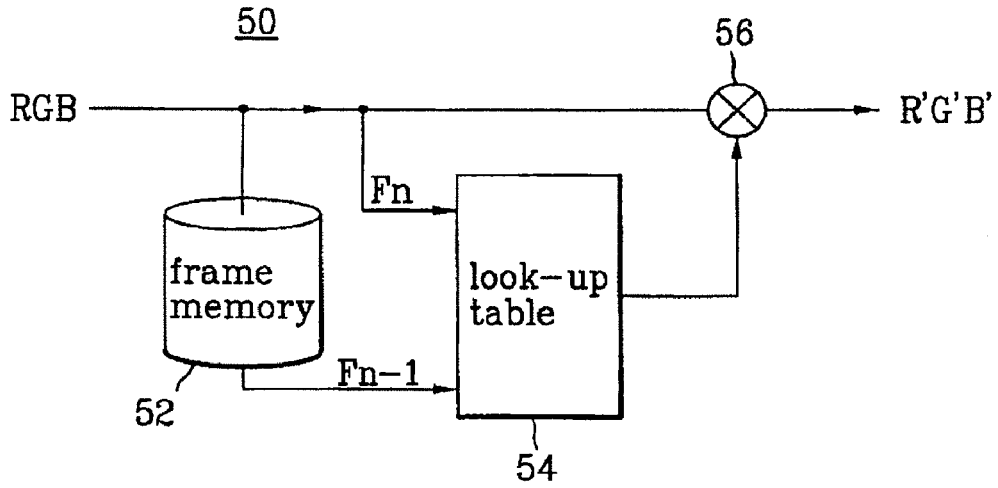
FIG. 4 Related Art
FIG. 4 is a block diagram illustrating a related art over-driving apparatus.
Figure 5:
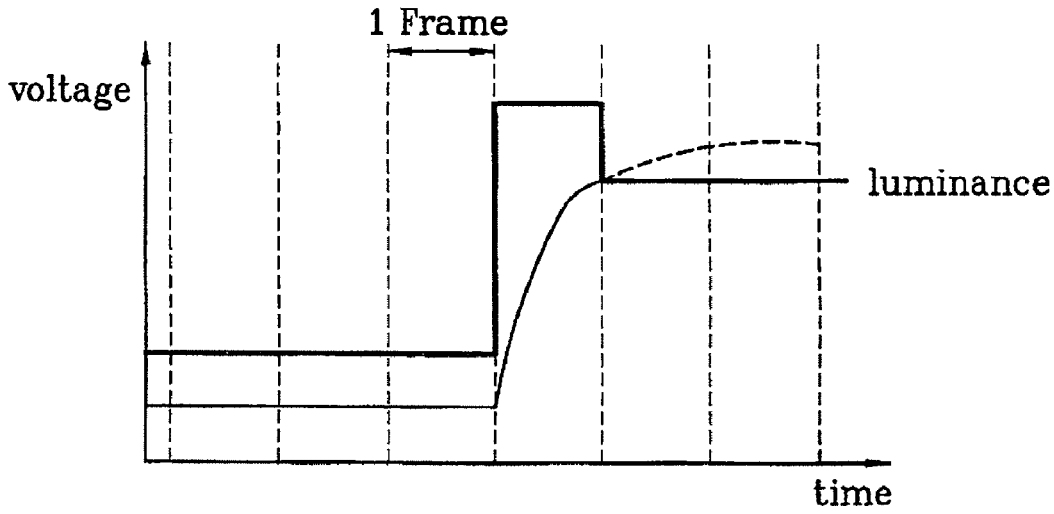
FIG. 5 Related Art
FIG. 5 illustrates the response speed and luminance of a liquid crystal cell in a related art over-driving apparatus shown in FIG. 4.
Figure 6:
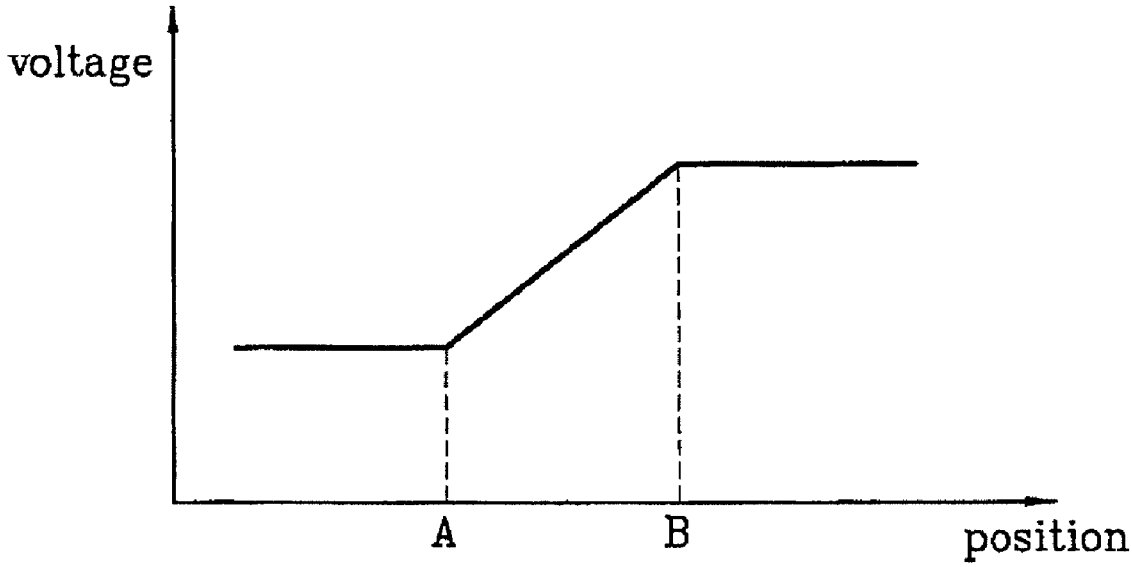
FIG. 6 Related Art
FIG. 6 illustrates boundaries of an image according to the relate art.
Figure 7:
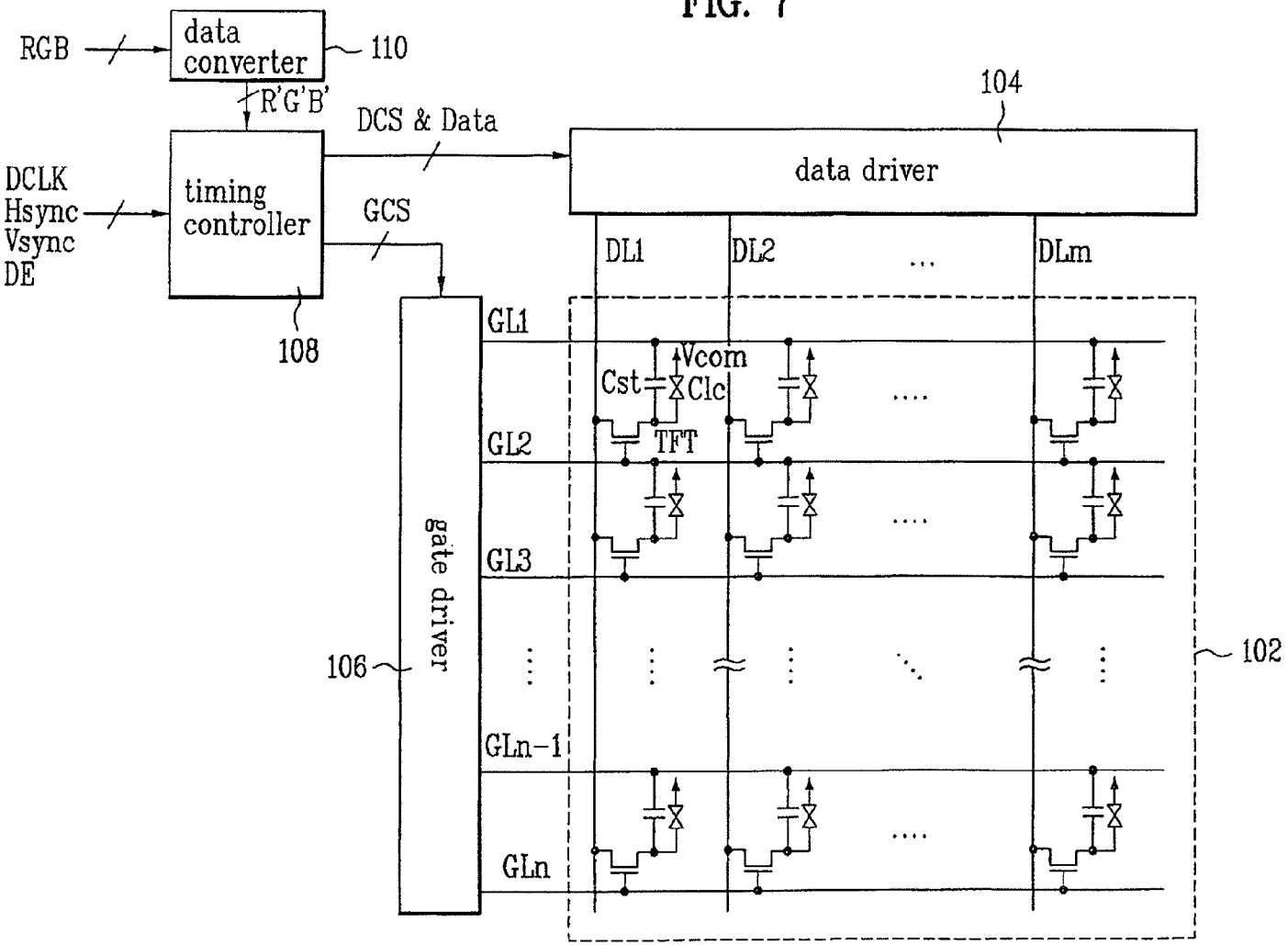
FIG. 7 illustrates an apparatus that drives an LCD device.

FIG. 7 illustrates an apparatus that drives an LCD device. As shown in FIG. 7, the apparatus that drives an LCD device includes an image display unit 102 that includes liquid crystal cells formed in each region defined by first to n-th gate lines GL1 to GLn and first to m-th data lines DL1 to DLm. A data driver 104 supplies analog video signals to the data lines DL1 to DLm. A gate driver 106 supplies scan pulses to the gate lines GL1 to GLn. A data converter 110 detecting motion vectors from externally input data RGB and generates modulated data R'G'B' by filtering the data RGB in accordance with the motion vectors to generate overshoot or undershoot in a boundary along a motion direction. A timing controller 108 aligns the modulated data R'G'B' from the data converter 110 and supplies the aligned data to the data driver 104, generates data control signals DCS that control the data driver 104, and generates gate control signals GCS that control the gate driver 106.

The image display unit 102 includes a transistor array substrate, a color filter array substrate, a spacer, and a liquid crystal. The transistor array substrate and the color filter array substrate face each other and are bonded to each other. The spacer uniformly maintains a cell gap between the two substrates. The liquid crystal is filled in a liquid crystal area prepared by the spacer.

The image display unit 102 includes a TFT formed in the region defined by the gate lines GL1 to GLn and the data lines DL1 to DLm, and the liquid crystal cells are connected to the TFT. The TFT supplies the analog video signals from the data lines DL1 to DLm to the liquid crystal cells in response to the scan pulses from the gate lines GL1 to GLn. The liquid crystal cell is comprised of common electrodes that face each other by interposing the liquid crystal therebetween and pixel electrodes connected to the TFT. Therefore, the liquid crystal cell is equivalent to a liquid crystal capacitor Clc. The liquid crystal cell includes a storage capacitor Cst connected to a previous gate line to maintain the analog video signals filled in the liquid crystal capacitor Clc until the next analog video signals are filled therein.

The data converter 110 detects the motion vectors of the externally input data RGB, generates the modulated data R'G'B' by filtering the data RGB in response to the detected motion vectors to generate overshoot or undershoot in the boundary along the motion direction, and supplies the generated modulated data R'G'B to the timing controller 108. In other words, the data converter 110 generates overshoot if the gray level is changed from a low gray level to a high gray level in the boundary along the motion direction. The data converter 110 generates undershoot if the gray level is changed from a high gray level to a low gray level in the boundary along the motion direction.

The timing controller 108 aligns the modulated data R'G'B' supplied from the data converter 110 to be suitable for driving of the image display unit 102, and supplies the aligned data signal to the data driver 104. The timing controller 108 generates the data control signals DCS and the gate control signals GCS using a dot clock DCLK, a data enable signal DE, and horizontal and vertical synchronizing signals Hsync and Vsync that are externally input, so as to control each driving timing of the data driver 104 and the gate driver 106.

The gate driver 106 includes a shift register that sequentially generates scan pulses, for example, gate high pulses in response to a gate start pulse GSP and a gate shift clock GSC among the gate control signals GCS from the timing controller 108. The gate driver 106 sequentially supplies the gate high pulses to the gate lines GL of the image display unit 102 to turn on the TFT connected to the gate lines GL.

The data driver 104 converts the data signal aligned from the timing controller 108 into the analog video signals in response to the data control signals DCS supplied from the timing controller 108, and supplies the analog video signals corresponding to one horizontal line per one horizontal period in which the scan pulses are supplied to the gate lines GL to the data lines DL. In other words, the data driver 104 generates the analog video signals by selecting a gamma voltage having a predetermined level depending on a gray level value of the data signal, and supplies the generated analog video signals to the data lines DL1 to DLm. The data driver 104 then inverses polarity of the analog video signals supplied to the data lines DL in response to a polarity control signal POL.

Figure 8:
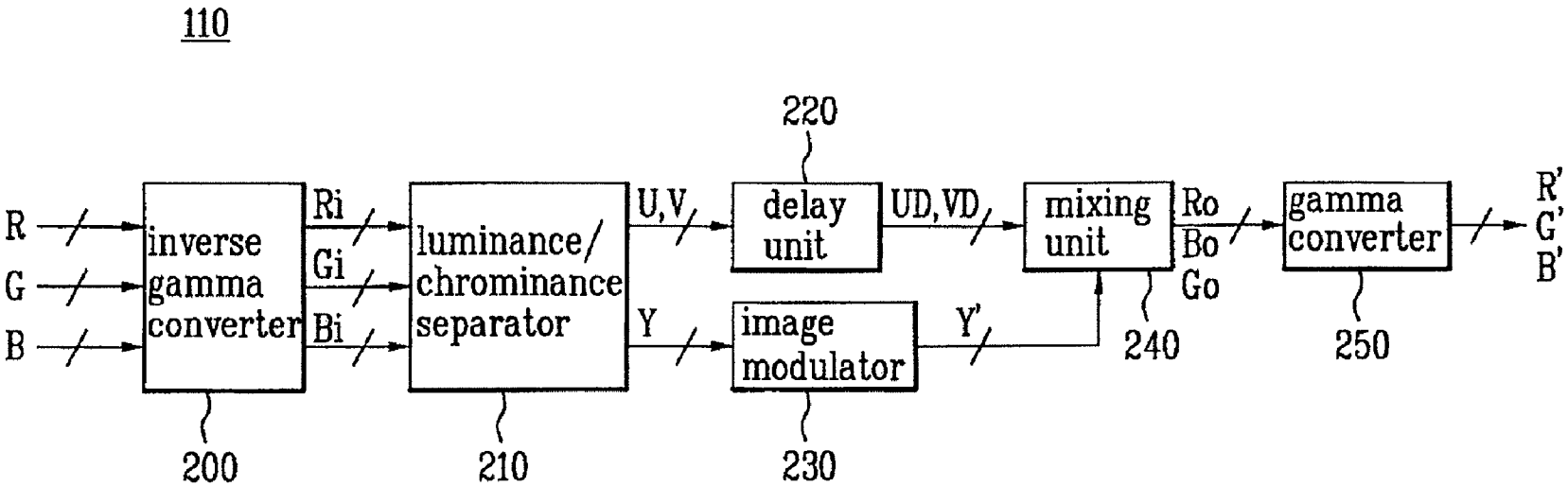
FIG. 8 is a block diagram that illustrates the data converter shown in FIG. 7.

FIG. 8 is a block diagram illustrating the data converter 110 shown in FIG. 7.

Referring to FIG. 8, the data converter 110 includes an inverse gamma converter 200, a separator 210, a delay unit 220, an modulator 230, a mixer 240, and a gamma converter 250.

The inverse gamma converter 200 converts the externally input data RGB into first linear data Ri, Gi and Bi using the following equation (1) because the externally input data RGB has undergone gamma correction considering output characteristics of a cathode ray tube.

$$Ri=R^{\lambda}$$

$$Gi=G^{\lambda}$$

$$Bi=B^{\lambda} \quad (1)$$

The separator 210 separates the first data Ri, Gi and Bi of a frame unit into a luminance component Y and chrominance components U and V. The luminance component Y and the chrominance components U and V are respectively obtained by the following equations (2) to (4).

$$Y=0.229\times Ri+0.587\times Gi+0.114\times Bi \quad (2)$$

$$U=0.493\times(Bi-Y) \quad (3)$$

$$V=0.887\times(Ri-Y) \quad (4)$$

The separator 210 supplies the luminance component Y separated from the first data Ri, Gi and Bi by the equations 2 to 4 to the modulator 230 and also supplies the chrominance components U and V separated from the first data Ri, Gi and Bi to the delay unit 220.

The modulator 230 detects the motion vectors using the luminance component Y from the separator 210, and supplies to the mixing unit 240 a luminance component Y' modulated by filtering the luminance component Y in accordance with the detected motion vectors to generate overshoot or undershoot in the boundary along a motion direction.

The delay unit 220 generates delayed chrominance components UD and VD by delaying the chrominance components U and V of a frame unit while the modulator 230 filters the luminance component Y of a frame unit. The delay unit 220 supplies to the mixer 240 the delayed chrominance components UD and VD to synchronize with the modulated luminance component Y'.

The mixer 240 generates second data Ro, Go and Bo by mixing the modulated luminance component Y' supplied from the modulator 230 with the chrominance components UD and VD supplied from the delay unit 220. At this time, the second data Ro, Go and Bo are obtained by the following equations (5) to (7).

$$Ro=Y'+0.000\times UD+1.140\times VD \quad (5)$$

$$Go=Y'-0.396\times UD-0.581\times VD \quad (6)$$

$$Bo=Y'+2.029\times UD+0.000\times VD \quad (7)$$

The gamma converter 250 performs gamma correction for the second data Ro, Go and Bo supplied from the mixer 240 using the following equation 8 to convert the resultant data into modulated data R'G'B'.

$$R'=(Ro)^{1/\lambda}$$

$$G'=(Go)^{1/\lambda}$$

$$B'=(Bo)^{1/\lambda} \quad (8)$$

The gamma converter 250 performs gamma correction for the second data Ro, Go and Bo to the modulated data R'G'B' suitable for a driving circuit of the image display unit 102 using a look-up table, and supplies the resultant data to the timing controller 108.

The data converter 110 detects the motion vectors from the input data RGB and modulates the image by filtering the luminance component Y in accordance with the detected motion vectors to generate overshoot or undershoot in the boundary along a motion direction of the image. As a result, it is possible remove motion blurring occurring in the boundary along a motion direction of the image.

Figure 9:
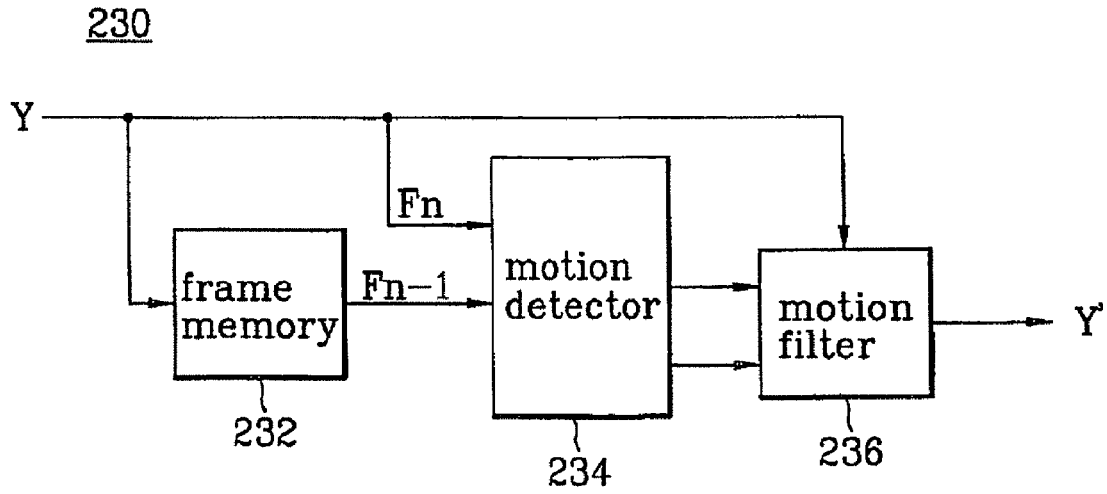
FIG. 9 is a block diagram that illustrates an image modulator as shown in FIG. 8.

FIG. 9 is a block diagram illustrating the modulator 230 shown in FIG. 8.

The modulator 230 includes a memory 232 that stores the luminance component Y that is supplied from the separator 210 for the unit of frame, a motion detector 234 that detects motion vectors Md and Ms using a luminance component Y of a previous frame Fn−1 stored in the memory 232 and a luminance component Y of a current frame Fn supplied from the separator 210, and a motion filter 236 that filters the luminance component Y in accordance with the motion vectors Md and Ms to generate overshoot or undershoot in the boundary of a motion direction.

The memory 232 stores the luminance component Y that is supplied from the separator 210 for the unit of frame, and supplies the luminance component Y to the motion detector 234.

The motion detector 234 detects the motion vectors Md and Ms, which include motion direction and motion speed, by comparing the luminance component Y of the previous frame Fn−1 stored in the memory 232 with the luminance component Y of the current frame Fn supplied from the separator 210 in a micro-block unit on the image display unit 102. The motion detector 234 supplies the detected motion vectors to the motion filter 236.

Figure 10A:
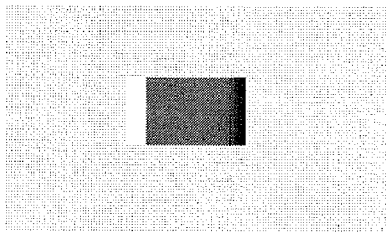
FIGS. 10A to 10D illustrate motion direction between images.
Figure 10B:
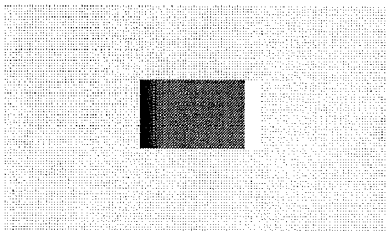
Figure 10C:
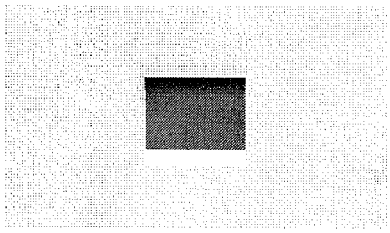
Figure 10D:
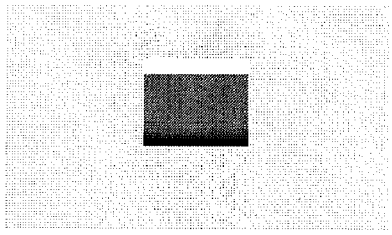

The motion direction Md, as shown in FIGS. 10A to 10D, is determined by motion of the image displayed by the previous frame Fn−1 and the current frame Fn, such as left side to the right side (FIG. 10A), left side to the right side (FIG. 10B), lower side to the upper side (FIG. 10C), and upper side to the lower side (FIG. 10D). The motion direction Md can be determined by motion of two diagonal directions, for example, a first diagonal direction from upper side to lower side and a second diagonal direction from lower side to upper side.

The motion speed Ms is determined by the size in the motion direction Md.

The motion filter 236 detects the boundary of the moving image by differentiating the input luminance component Y. The motion filter 236 generates the modulated luminance component Y' by filtering the luminance component Y to generate overshoot or undershoot in the boundary of the detected image in accordance with the motion direction Md and the motion speed Ms from the motion detector 234.

Figure 11:
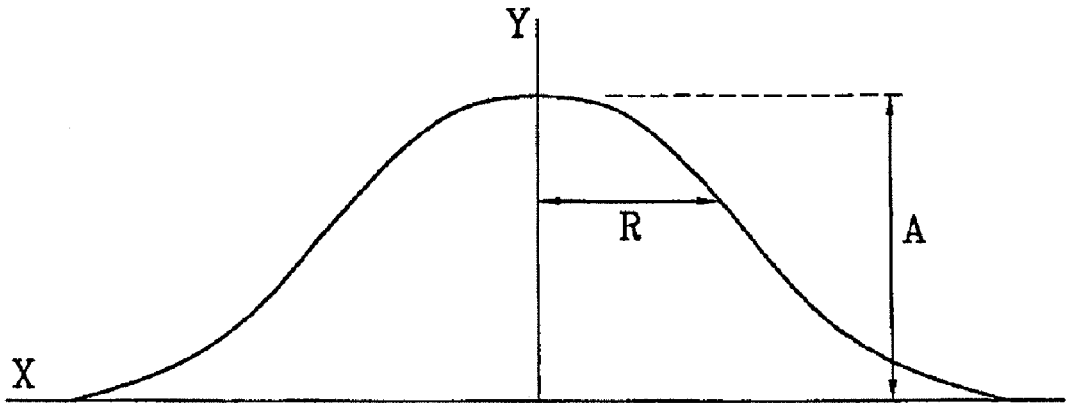
FIG. 11 illustrates Gaussian distribution of a luminance component shown in FIG. 9.

The motion filter 236, as shown in FIG. 11, filters the luminance component Y to generate overshoot or undershoot in the boundary of the detected image in accordance with the following equation (9) using Gaussian distribution.

$$G(x,y)=A\times e^{\wedge}(-(x^2+y^2)/2R^2) \quad (9)$$

Figure 12:
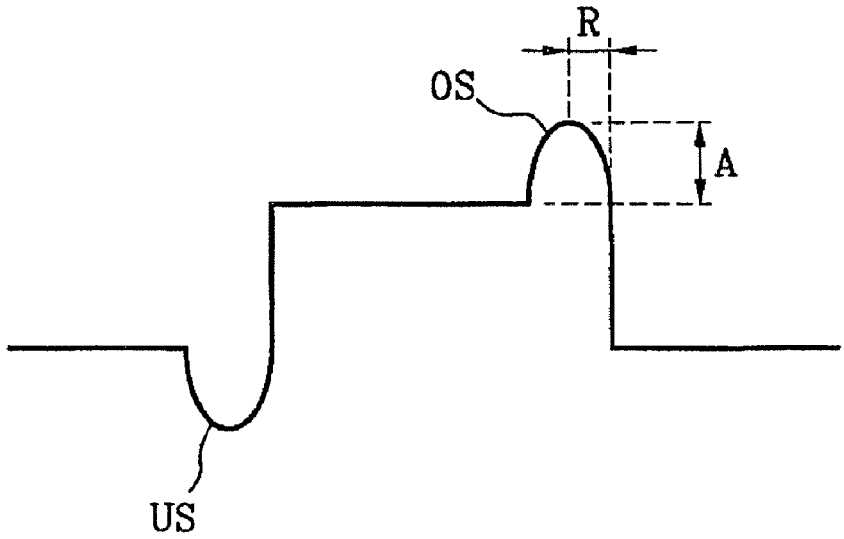
FIG. 12 illustrates overshoot and undershoot occurring in boundaries of an image shown in FIG. 9.
Figure 13A:
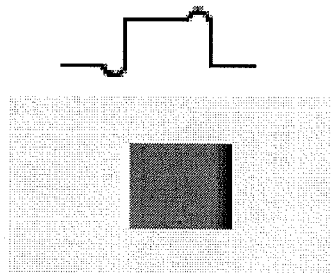
FIGS. 13A to 13D illustrate overshoot and undershoot that occurs in boundaries of an image shown in FIG. 9 in accordance with motion direction and speed.
Figure 13B:
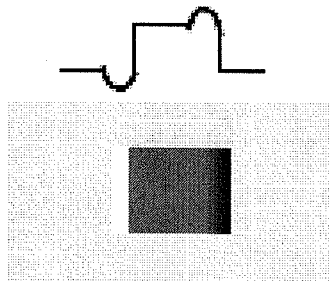
Figure 13C:
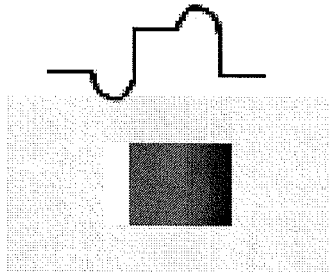
Figure 13D:
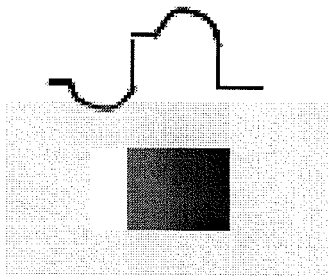

As shown in FIG. 12, the motion filter 236 generates undershoot US in the boundary along a motion direction if the gray level is changed from a high gray level to a low gray level in the boundary, and generates overshoot OS in the boundary along a motion direction if the gray level is changed from low gray level to high gray level in the boundary. A depth of overshoot OS or undershoot US in the boundary increases in proportion to the size of A, and its distribution size is determined in accordance with the size of R.

For example, as shown in FIGS. 13A to 13D, height, depth and distribution size of overshoot OS or undershoot US are determined in accordance with the motion direction Md of the image and the motion speed Ms of a frame unit. Referring to the equation 9, A and R increase in the boundary along a motion direction as the motion speed Ms and the motion direction Md increase. As a result, the motion filter 236 generates overshoot OS having a large distribution size and high height and undershoot US having a large distribution size and deep depth.

Figure 14:
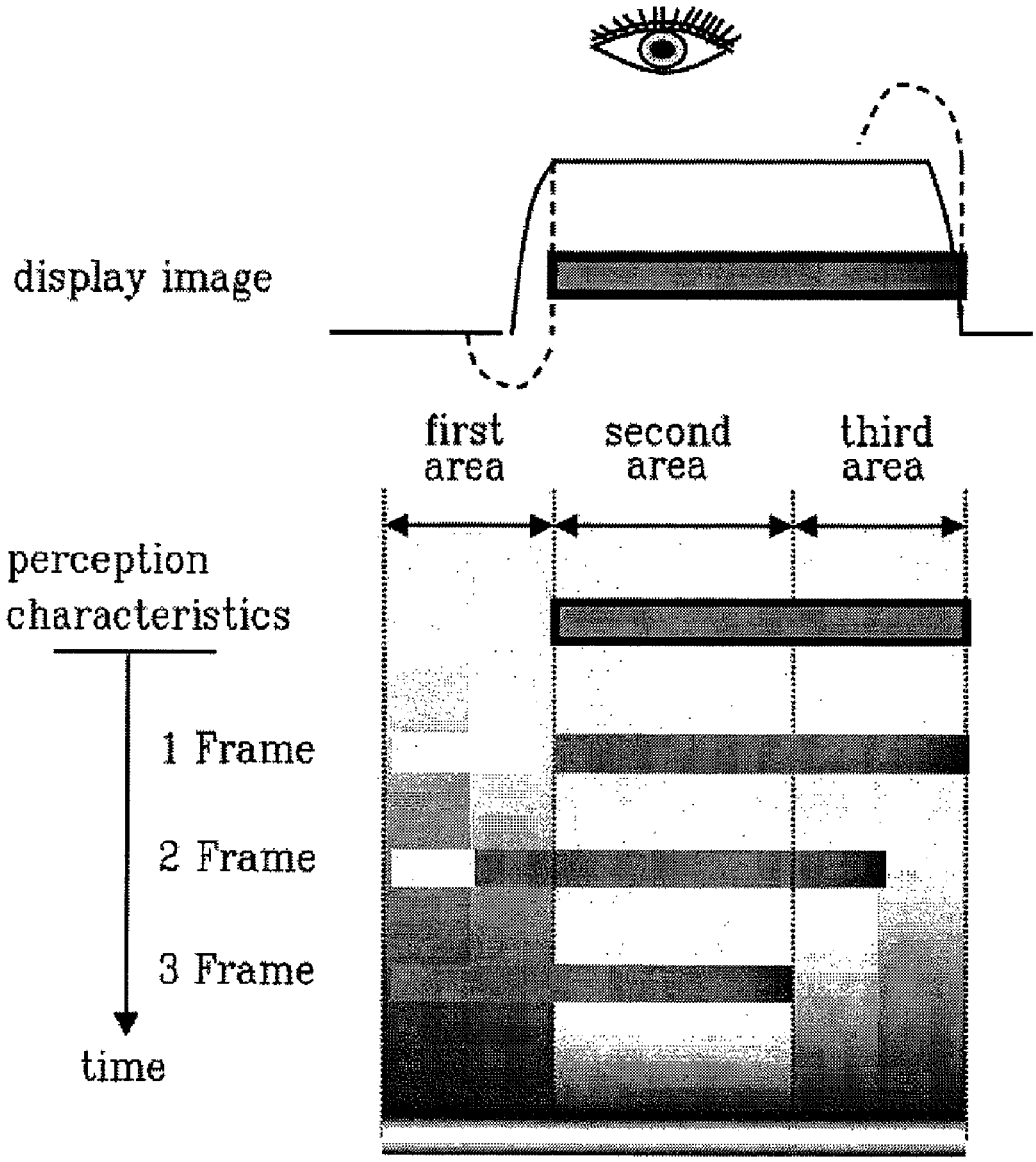
FIG. 14 illustrates motion blurring removed by an apparatus and method for driving an LCD device.

The image modulator 230, as shown in FIG. 14, moves from left side to right side (frame 1 to frame 2 to frame 3 . . . ) using the motion filter 236 to generate undershoot in the boundary of the image whose gray level is changed from a high gray level to a low gray level and overshoot in the boundary of the image whose gray level is changed from a low gray level to a high gray level.

High frequency components, for example, overshoot and undershoot occur in the boundary along the motion direction of the image in accordance with a human being's perception having low frequency characteristics. As a result, in the apparatus and method for driving an LCD device, overshoot and undershoot are offset with each other so as to remove motion blurring.

Figure 16:
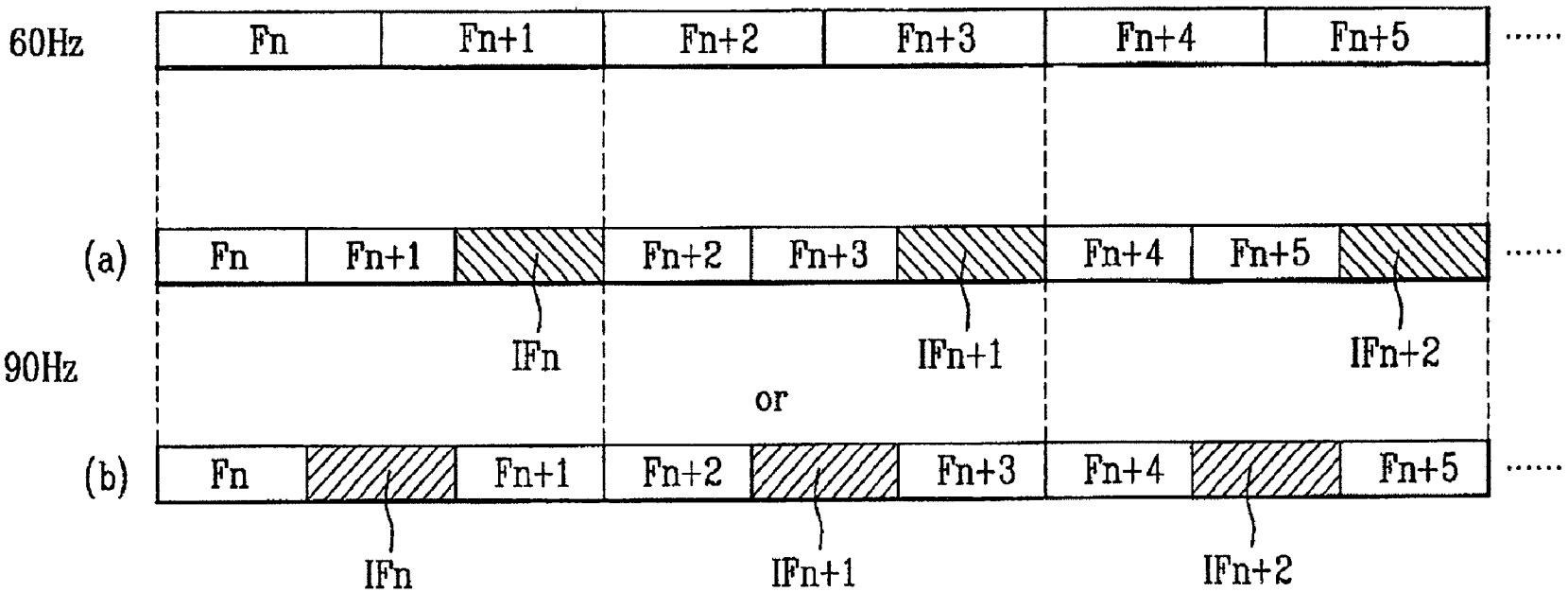
FIG. 16 illustrates the order of respective frames that convert an image driven at 60 Hz into an image driven at 90 Hz using an insertion frame shown in FIG. 15.

FIG. 16 illustrates a method for driving an LCD device according to another embodiment.

Referring to FIG. 16, an image driven at a frequency of 60 Hz is displayed at a frequency of 90 Hz, and overshoot and undershoot occur in the boundary along the motion direction of the image so as to effectively remove motion blurring occurring in the boundary of the image.

Figure 15:
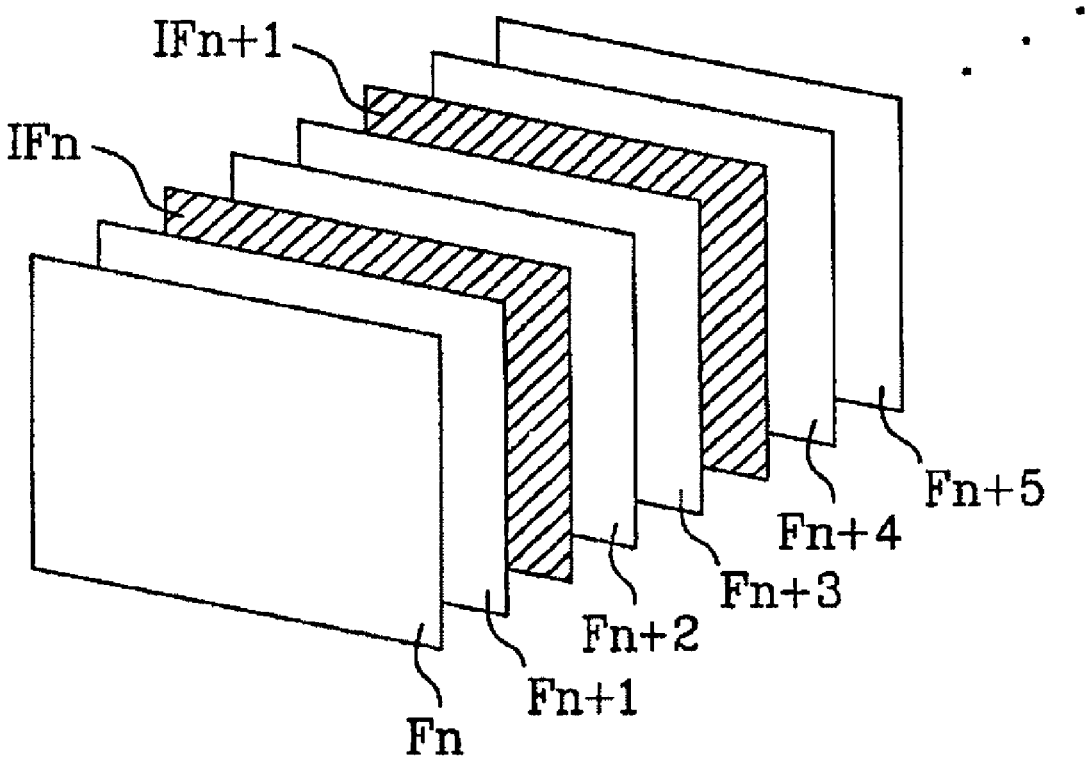
FIG. 15 illustrates a method that drives an LCD device according to another embodiment.

An insertion frame IFn, as shown in FIG. 15, is generated using first to third adjacent frames Fn, Fn+1, and Fn+2 driven at a frequency of 60 Hz, and two frames are converted into three frames using the generated insertion frame IFn so as to display the image at a frequency of 90 Hz.

The insertion frame IFn may be inserted between the second and third frames Fn+1 and Fn+2 driven at a frequency of 60 Hz as shown in FIG. 16 (*a*) or between the first and second Fn and Fn+1 driven at a frequency of 60 Hz as shown in FIG. 16 (*b*).

In the method for driving an LCD device, motion blurring is removed by generating overshoot and undershoot in the boundary along the motion direction of the image driven at a frequency of 90 Hz using the data converter shown in FIG. 8.

Figure 17:
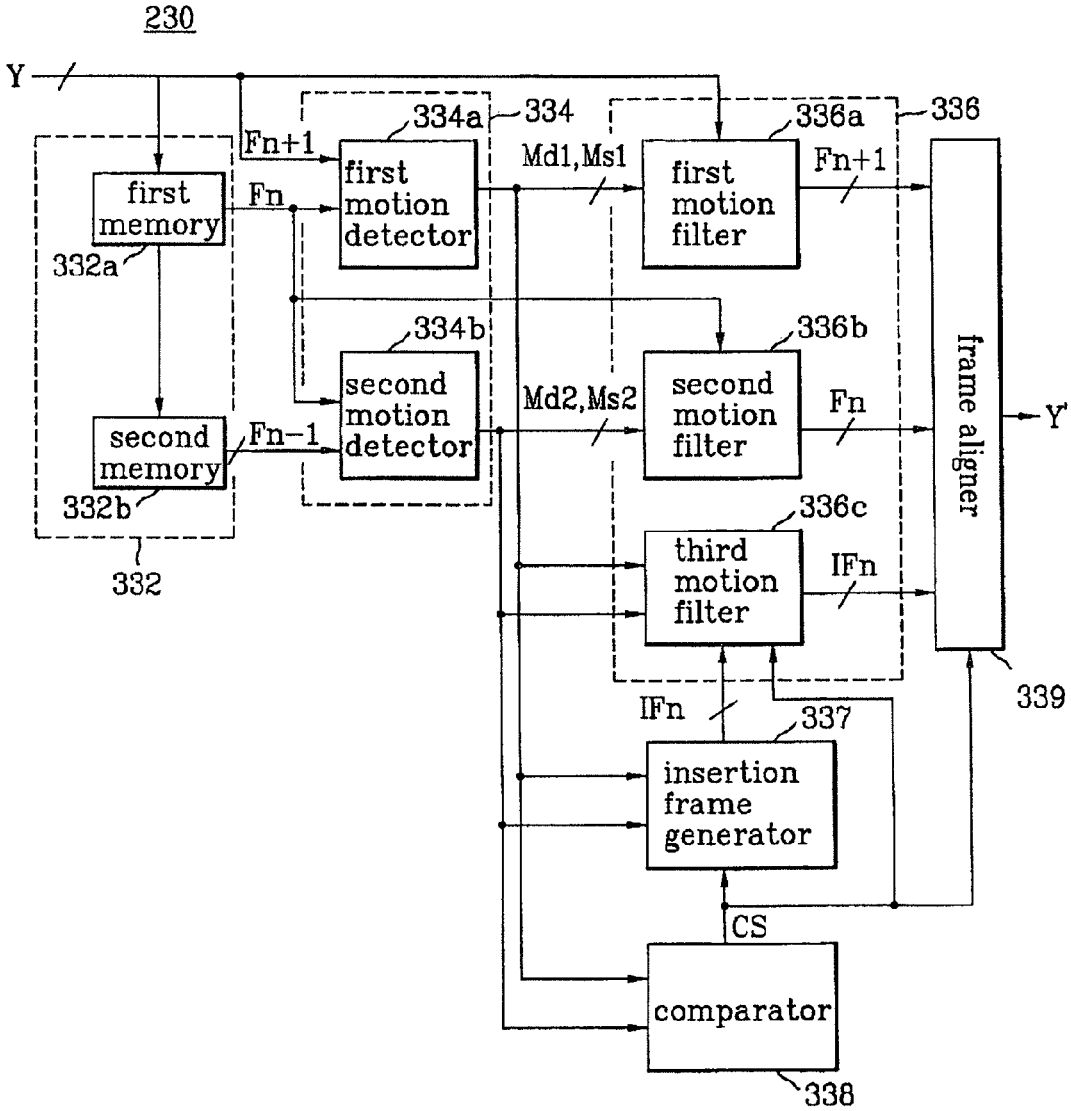
FIG. 17 illustrates an image modulator of an apparatus for driving an LCD device according to another embodiment.

FIG. 17 illustrates an image modulator 230 of an apparatus for driving an LCD device according to another embodiment.

The apparatus for driving an LCD device according to another embodiment has the same configuration as that of the apparatus shown in FIGS. 7 and 8 excluding the image modulator 230, as shown in FIG. 17.

As shown in FIG. 17 in connection with FIG. 8, the image modulator 230 includes a memory 332 that stores the luminance component Y supplied from the separator 210 for the unit of frame. A motion vector generator 334 detects motion vectors Md1, Ms1, Md2, and Ms2 using the luminance component Y of the current frame Fn stored in the memory unit 332 and the luminance component Y of the next frame Fn+1 supplied from the separator 210. A comparator 338 generates a comparing signal CS by comparing the motion vectors Md1 and Ms1 with the motion vectors Md2 and Ms2. An insertion frame generator 337 generates an insertion frame IFn by selecting the motion vectors Md1, Ms1, Md2, and Ms2 corresponding to the comparing signal CS. A motion filter 336 generates each modulated luminance component Y' of the current frame Fn and the next frame Fn+1 by filtering each luminance component Y of the current frame Fn and the next frame Fn+1 in accordance with the motion vectors Md1, Ms1, Md2, and Ms2 to generate overshoot or undershoot in the boundary of a motion direction. The motion filter 336 generates a modulated luminance component Y' of the insertion frame IFn by filtering the luminance component of the insertion frame IFn. A frame aligner 339 aligns the order of the modulated luminance components Y' of the current, next and insertion frames Fn, Fn+1 and IFn supplied from the motion filter 336 in accordance with the comparing signal CS to obtain a driving frequency of 90 Hz and supplies the aligned data to the mixing unit 240.

The memory 332 includes a first memory 332*a* that stores the luminance component Y supplied from the separator 210 for the unit of frame, and a second memory 332*b* that stores the luminance component Y of the current frame stored in the first memory.

The first memory 332*a* stores the luminance component Y of the current frame Fn supplied from the separator 210 and supplies the luminance component Y of the stored current frame Fn to the motion vector generator 334 and the second memory 332*b*.

The second memory 332*b* stores the luminance component Y of the current frame Fn supplied from the first memory 332*a* as the luminance component Y of the previous frame Fn−1 and supplies the stored luminance component Y of the previous frame Fn−1 to the motion vector generator 334.

The motion vector generator 334 includes a first motion detector 334*a* that detects first motion vectors Md1 and Ms1 using the luminance component Y of the current frame Fn stored in the first memory 332*a* and the luminance component Y of the next frame Fn+1 supplied from the separator 210. A second motion detector 334*b* detects second motion vectors Md2 and Ms2 using the luminance component Y of the current frame Fn stored in the first memory 332*a* and the luminance component Y of the previous frame Fn−1 stored in the second memory 332*b*.

The first motion detector 334*a* detects the first motion vectors Md1 and Ms1, which include the first motion direction Md1 and the first motion speed Ms1, by comparing the luminance component Y of the current frame Fn with the luminance component Y of the next frame Fn+1 in a micro-block unit on the image display unit 102. The first motion detector 334*a* supplies the detected first motion vectors Md1 and Ms1 to the motion filter 336. The first motion direction Md1, as shown in FIGS. 10A to 10D, is determined by the motion of the image displayed by the current frame Fn and the next frame Fn+1, such as left side to the right side (FIG. 10A), left side to the right side (FIG. 10B), lower side to the upper side (FIG. 100), and upper side to the lower side (FIG. 10D). Also, the first motion speed Ms1 is determined by motion of the first motion direction Md1.

The second motion detector 334*b* detects the second motion vectors Md2 and Ms2, which include the second motion direction Md2 and the second motion speed Ms2, by comparing the luminance component Y of the current frame Fn with the luminance component Y of the previous frame Fn−1 in a micro-block unit on the image display unit 102. The second motion detector 334*b* supplies the detected second motion vectors Md2 and Ms2 to the motion filter 336. The second motion direction Md2, as shown in FIGS. 10A to 10D, is determined by motion of the image displayed by the previous frame Fn−1 and the current frame Fn, such as left side to the right side (FIG. 10A), left side to the right side (FIG. 10B), lower side to the upper side (FIG. 10C), and upper side to the lower side (FIG. 10D). The second motion speed Ms2 is determined by motion of the second motion direction Md2.

The comparator 338 generates the comparing signal CS by comparing the first motion vectors Md1 and Ms1 from the first motion detector 334*a* with the second motion vectors Md2 and Ms2 from the second motion detector 334*b*. The comparing signal CS is used to determine the position that inserts the insertion frame IFn among the previous, current and next frames Fn−1, Fn, and Fn+1.

The insertion frame generator 337 generates the insertion frame IFn using the first motion vectors Md1 and Ms1 or the second motion vectors Md2 and Ms2 in accordance with the comparing signal CS, and supplies the generated insertion frame IFn to the motion filter 336. For example, if the insertion frame IFn is inserted between the previous frame Fn−1 and the current frame Fn in order to drive the image at a driving frequency of 90 Hz, it is generated by the first motion vectors Md1 and Ms1 as an image having motion between the frames Fn−1 and Fn. By contrast, if the insertion frame IFn is inserted between the current frame Fn and the next frame Fn+1 in order to drive the image at a driving frequency of 90 Hz, it is generated by the second motion vectors Md2 and Ms2 as an image having motion between the frames Fn and Fn+1.

The motion filter 336 includes a first motion filter 336*a* filtering the luminance component Y of the next frame Fn+1 to generate overshoot or undershoot in the boundary of the motion direction in accordance with the first motion vectors Md1 and Ms1. A second motion filter 336*b* filters the luminance component Y of the current frame Fn to generate overshoot or undershoot in the boundary of the motion direction in accordance with the second motion vectors Md2 and Ms2. A third motion filter 336*c* filters the luminance component Y of the insertion frame IFn to generate overshoot or undershoot in the boundary of the motion direction in accordance with the first motion vectors Md1 and Ms1 or the second motion vectors Md2 and Md2 selected by the comparing signal CS.

The first motion filter 336*a* detects the boundary of the moving image by differentiating the luminance component Y of the next frame Fn+1 in the same manner as the motion filter 236 of the image modulator 230 according to the aforementioned embodiment. The first motion filter 336*a* generates the modulated luminance component Y' of the next frame Fn+1 by filtering the luminance component Y of the next frame Fn+1 to generate overshoot or undershoot in the boundary of the detected image in accordance with the first motion direction Md1 and the first motion speed Ms1.

The second motion filter 336*b* detects the boundary of the moving image by differentiating the luminance component Y of the current frame Fn in the same manner as the motion filter 236 of the image modulator 230 according to the aforementioned embodiment. The second motion filter 336*b* generates the modulated luminance component Y' of the current frame Fn by filtering the luminance component Y of the current frame Fn to generate overshoot or undershoot in the boundary of the detected image in accordance with the second motion direction Md2 and the second motion speed Ms2.

The third motion filter 336*c* detects the boundary of the moving image by differentiating the luminance component Y of the insertion frame IFn in the same manner as the motion filter 236 of the image modulator 230 according to the aforementioned embodiment. The third motion filter 336*c* generates the modulated luminance component Y' of the insertion frame IFn by filtering the luminance component Y of the insertion frame IFn to generate overshoot or undershoot in the boundary of the detected image in accordance with either the first motion direction Md1 and the first motion speed Ms1 or the second motion direction Md2 and the second motion speed Ms2 selected by the comparing signal CS.

The frame aligner 339 aligns the order of the modulated luminance components Y' of the current, next and insertion frames Fn, Fn+1 and IFn are supplied from the first to third motion filters 336*a*, 336*b* and 336*c* in accordance with the comparing signal CS to obtain a driving frequency of 90 Hz as shown in FIG. 16 (*a*) or 16 (*b*), and supplies the aligned data to the mixer 240.

According to another embodiment, if the gray level is changed from a high gray level to a low gray level in the boundary of the image moving in accordance with the motion direction and the motion speed, overshoot occurs in the boundary. If the gray level is changed from a low gray level to a high gray level in the boundary, the image is filtered to generate undershoot in the boundary and then modulated. The image driven at a frequency of 60 Hz is driven at a frequency of 90 Hz using the insertion frame. It is possible to remove motion blurring and also obtain a clearer image.

Figure 19:
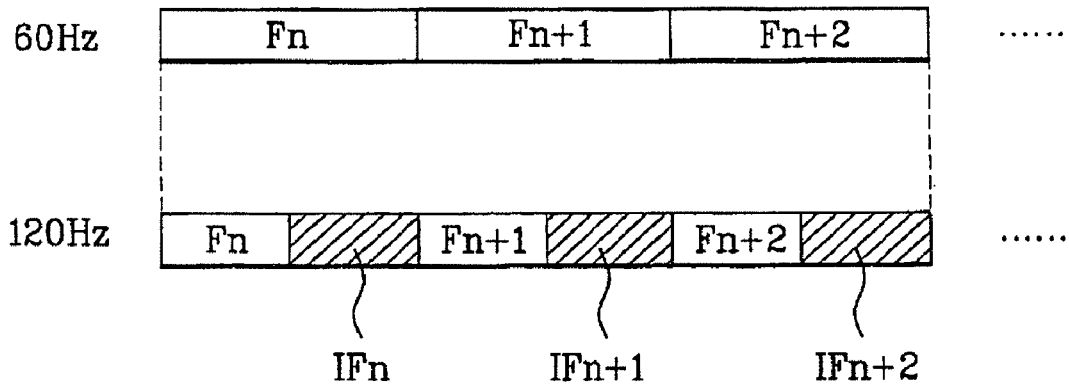
FIG. 19 illustrates the order of respective frames that convert an image driven at 60 Hz into an image driven at 120 Hz using an insertion frame shown in FIG. 18.

FIG. 19 illustrates a method for driving an LCD device according to another embodiment of the present invention.

As shown in FIG. 19, in the method for driving an LCD device according to another embodiment, an image driven at a frequency of 60 Hz is displayed at a frequency of 120 Hz, and overshoot and undershoot occur in the boundary along the motion direction of the image so as to effectively remove motion blurring occurring in the boundary of the image.

Figure 18:
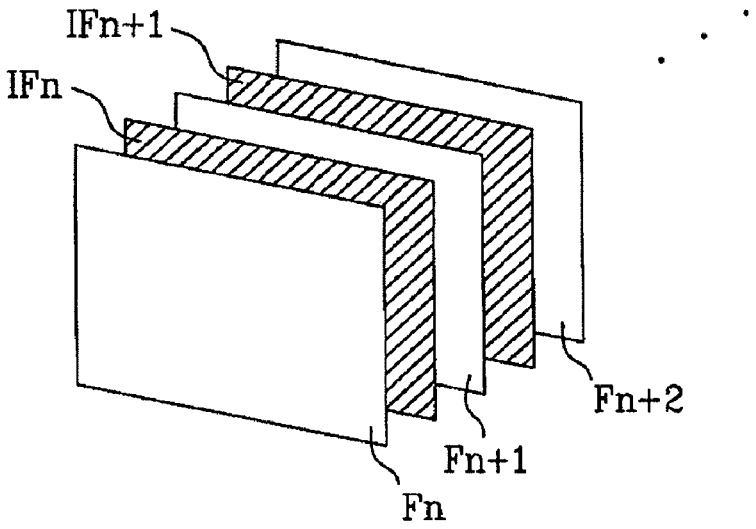
FIG. 18 illustrates a method for driving an LCD device according to another embodiment.

In more detail, in the method for driving an LCD device according to another embodiment, as shown in FIG. 18, the insertion frame IFn is generated using previous and current frames Fn−1 and Fn adjacent to each other and driven at a frequency of 120 Hz, and the generated insertion frame IFn is inserted between the previous and current frames Fn−1 and Fn so as to drive the image at a frequency of 120 Hz.

In the method for driving an LCD device according to another embodiment, motion blurring is removed by generating overshoot and undershoot in the boundary along the motion direction of the image driven at a frequency of 120 Hz using the data converter shown in FIG. 8.

Figure 20:
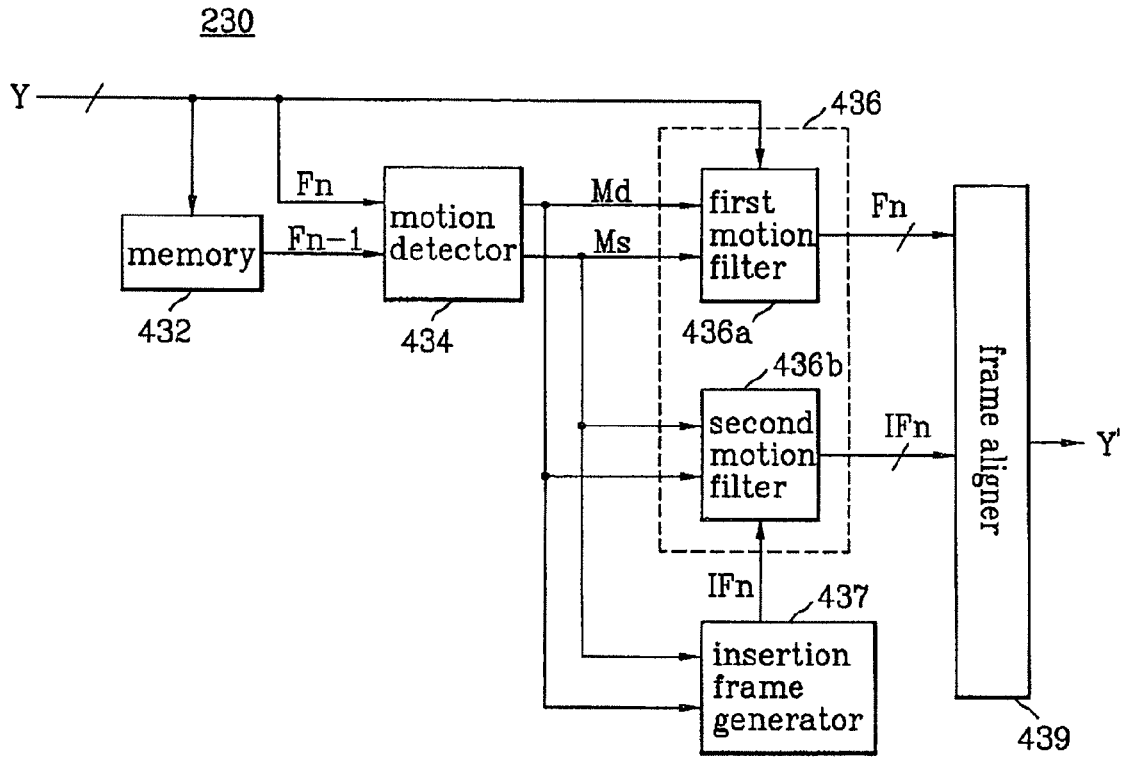
FIG. 20 illustrates an image modulator of an apparatus that drives an LCD device according to another embodiment.

FIG. 20 illustrates a modulator 230 of an apparatus for driving an LCD device according to another embodiment.

The apparatus for driving an LCD device has the same configuration as that of the apparatus according to the aforementioned embodiment shown in FIGS. 7 and 8 excluding the modulator 230 shown in FIG. 20.

As shown in FIG. 20 in connection with FIG. 8, the modulator 230 includes a memory 432 that stores the luminance component Y supplied from the separator 210 for the unit of frame. A motion detector 434 detects motion vectors Md and Ms using the luminance component Y of the current frame Fn supplied from the separator 210 and the luminance component Y of the previous frame Fn−1 stored in the memory 432. An insertion frame generator 437 generates the insertion frame IFn using the motion vectors Md and Ms. A motion filter 436 generates the modulated luminance component Y' of the current frame Fn by filtering the luminance component Y of the current frame Fn in accordance with the motion vectors Md and Ms to generate overshoot or undershoot in the boundary of the motion direction. The motion filter 436 generates the modulated luminance component Y' of the insertion frame IFn by filtering the luminance component of the insertion frame IFn. A frame aligner 439 aligns the order of the modulated luminance components Y' of the current and insertion frames Fn and IFn supplied from the motion filter 436 to obtain a driving frequency of 120 Hz and supplies the aligned data to the mixing unit 240.

The memory 432 stores the luminance component Y supplied from the separator 210 for the unit of frame, and supplies the stored luminance component Y to the motion detector 434.

The motion detector 434 detects the motion vectors Md and Ms, which include the motion direction and the motion speed, by comparing the luminance component Y of the previous frame Fn−1 stored in the memory 432 with the luminance component Y of the current frame Fn supplied from the separator 210 in a micro-block unit on the image display unit 102. The motion detector 434 supplies the detected motion vectors to the motion filter 436. The motion direction Md, as shown in FIGS. 10A to 10D, is determined by motion of the image displayed by the previous frame Fn−1 and the current frame Fn, such as left side to the right side (FIG. 10A), left side to the right side (FIG. 10B), lower side to the upper side (FIG. 10C), and upper side to the lower side (FIG. 10D). The motion speed Ms is determined by the size in the motion direction Md.

The insertion frame generator 437 generates the insertion frame IFn using the motion vectors Md and Ms and supplies the generated insertion frame IFn to the motion filter 436. The insertion frame IFn is generated as an image having motion between the previous and current frames Fn−1 and Fn in order to drive the image at a driving frequency of 120 Hz.

The motion filter 436 includes a first motion filter 436*a* that filters the luminance component Y of the current frame Fn in accordance with the motion vectors Md and Ms to generate overshoot or undershoot in the boundary of the motion direction. A second motion filter 436*b* filters the luminance component Y of the insertion frame IFn in accordance with the motion vectors Md and Ms to generate overshoot or undershoot in the boundary of the motion direction.

The first motion filter 436*a* detects the boundary of the moving image by differentiating the luminance component Y of the current frame Fn in the same manner as the motion filter 236 of the image modulator 230 according to the aforementioned embodiment. The first motion filter 436*a* generates the modulated luminance component Y' of the current frame Fn by filtering the luminance component Y of the current frame Fn to generate overshoot or undershoot in the boundary of the detected image in accordance with the motion direction Md and the motion speed Ms.

The second motion filter 436*b* detects the boundary of the moving image by differentiating the luminance component Y of the insertion frame IFn in the same manner as the motion filter 236 of the image modulator 230 according to the aforementioned embodiment. The second motion filter 436*b* generates the modulated luminance component Y' of the insertion frame IFn by filtering the luminance component Y of the insertion frame IFn to generate overshoot or undershoot in the boundary of the detected image in accordance with the motion direction Md and the motion speed Ms.

The frame aligner 439 aligns the order of the modulated luminance components Y' of the current and insertion frames Fn and IFn supplied from the first and second motion filters 436*a* and 436*b* to obtain a driving frequency of 120 Hz as shown in FIG. 19, and supplies the aligned data to the mixer 240. The insertion frame IFn is positioned at the center between the previous and current frames Fn−1 and Fn.

According to another embodiment, if the gray level is changed from a low gray level to a high gray level in the boundary of the image moving in accordance with the motion direction and the motion speed, overshoot occurs in the boundary. If the gray level is changed from a high gray level to a low gray level in the boundary, the image is filtered to generate undershoot in the boundary and then modulated. The image driven at a frequency of 60 Hz is driven at a frequency of 120 Hz using the insertion frame. Thus, it is possible to remove motion blurring and also obtain a clearer image.

According to the present embodiment of the present invention, if the gray level is changed from a low gray level to a high gray level in the boundary of the image moving in accordance with the motion direction and the motion speed, overshoot occurs in the boundary. If the gray level is changed from a high gray level to a low gray level in the boundary, the image is filtered to generate undershoot in the boundary and then modulated. As a result, overshoot and undershoot are offset with each other so as to remove motion blurring.

According to the present embodiment, if the gray level is changed from a low gray level to a high gray level in the boundary of the image moving in accordance with the motion direction and the motion speed, overshoot occurs in the boundary. If the gray level is changed from a high gray level to a low gray level in the boundary, the image is filtered to generate undershoot in the boundary and then modulated. The image is driven at a higher frequency using the insertion frame. Thus, it is possible to remove motion blurring and obtain a clearer image.

As a result, it is possible to remove motion blurring using algorithm without changing panel design and hardware and to obtain a clearer image.

It will be apparent to those skilled in the art that various modifications and variations can be made without departing from the embodiments presented.

The invention claimed is:

1. An apparatus for driving an LCD device comprising:

an image display unit that includes liquid crystal cells formed in each region defined by a plurality of gate lines and a plurality of data lines;

a data driver that supplies analog video signals to the respective data lines;

a gate driver that supplies scan pulses to the respective gate lines;

a data converter that detects motion vectors from input data and generates modulated data that is filtered input data in accordance with the motion vectors that generate overshoot or undershoot in a boundary along a motion direction; and a timer that aligns the modulated data and supplies the aligned data to the data driver and operates the data driver and the gate driver, wherein the overshoot or undershoot in the boundary has Gaussian distribution and a height corresponding to the motion direction and the motion speed wherein the data converter generates one insertion frame that uses at least two adjacent frames, and generates the modulated data having a driving frequency higher than that of the data that use the generated insertion frame.

2. The apparatus as in claim 1, wherein the data converter generates overshoot if the gray level is changed from a low gray level to a high gray level in the boundary, and generates undershoot if gray level is changed from a high gray level to a low gray level in the boundary.

3. The apparatus as in claim 2, wherein the data converter includes:

an inverse gamma converter that performs inverse gamma correction on the data and generates first data;

a separator that separates the first data into luminance components and chrominance components;

an modulator that detects the motion vectors using the luminance component and generates a modulated luminance component, wherein the luminance component is filtered in accordance with the motion vectors;

a mixer that mixes the modulated luminance component with the chrominance components to generate second data; and a gamma converter that performs gamma correction on the second data from the mixer to generate modulated data.

4. The apparatus as in claim 3, wherein the motion vectors include motion direction and motion speed between adjacent frames.

5. The apparatus as in claim 4, wherein the image modulator includes:

a memory that stores the luminance component supplied from the separator for the unit of frame;

a motion detector that detects the motion vectors using a luminance component of a previous frame stored in the memory and a luminance component of a current frame supplied from the separator; and a filter that filters the luminance component in accordance with the motion vectors to generate overshoot or undershoot in the boundary.

6. The apparatus as in claim 4, wherein the modulator includes:

a memory that stores the luminance component supplied from the separator for the unit of frame;

a motion vector generator that detects a plurality of motion vectors using the luminance component of the current frame stored in the memory and a luminance component of a next frame supplied from the separator;

a comparator that generates a comparing signal by comparison of the motion vectors with each other;

an insertion frame generator that generates the insertion frame by selection of the motion vectors that correspond to the comparing signal;

a motion filter that generates modulated luminance components of the current frame and the next frame by filtering each luminance component of the current frame and the next frame in accordance with the motion vectors to generate overshoot or undershoot in the boundary, and generates a modulated luminance component of the insertion frame by filtering the luminance component of the insertion frame; and a frame aligner that aligns the order of the modulated luminance components of the current, next and insertion frames supplied from the motion filter in accordance with the comparing signal to obtain a driving frequency of 90 Hz and supplies the aligned data to the mixer.

7. The apparatus as in claim 6, wherein the memory includes:

a first memory that stores the luminance component supplied from the separator for the unit of frame; and a second memory that stores the luminance component of the current frame stored in the first memory.

8. The apparatus as in claim 7, wherein the motion vector generator includes:

a first motion detector that detects first motion vectors that use the luminance component of the current frame stored in the first memory and the luminance component of the next frame supplied from the separator; and a second motion detector that detects second motion vectors that use the luminance component of the current frame stored in the first memory and the luminance component of the previous frame stored in the second memory.

9. The apparatus as in claim 8, wherein the insertion frame generator generates the insertion frame with either the first motion vectors or the second motion vectors in accordance with the comparing signal, and supplies the generated insertion frame to the motion filter.

10. The apparatus as in claim 9, wherein the insertion frame generator generates the insertion frame having motion between the previous frame and the current frame using the first motion vectors in accordance with the comparing signal if the insertion frame is inserted between the previous frame and the current frame, and generates the insertion frame having motion between the current frame and the next frame using the second motion vectors if the insertion frame is inserted between the current frame and the next frame.

11. The apparatus as in claim 8, wherein the motion filter includes:

a first motion filter that generates the modulated luminance component of the next frame by filtering the luminance component of the next frame to generate overshoot or undershoot in the boundary in accordance with the first motion vectors;

a second motion filter that generates the modulated luminance component of the current frame by filtering the luminance component of the current frame to generate overshoot or undershoot in the boundary in accordance with the second motion vectors; and a third motion filter that generates the modulated luminance component of the insertion frame by filtering the luminance component of the insertion frame to generate overshoot or undershoot in the boundary using the motion vectors selected in accordance with the comparing signal.

12. The apparatus as in claim 11, wherein each motion filter generates overshoot or undershoot in the boundary to have Gaussian distribution and a height corresponding to the motion direction and the motion speed.

13. The apparatus as in claim 6, wherein the image modulator includes:

a memory that stores the luminance component supplied from the separator for the unit of frame;

a motion detector that detects the motion vectors using the luminance component of the current frame supplied from the separator and the luminance component of the previous frame stored in the memory;

an insertion frame generator that generates the insertion frame using the motion vectors;

a motion filter that generates the modulated luminance component of the current frame by filtering the luminance component of the current frame in accordance with the motion vectors to generate overshoot or undershoot in the boundary, and generates the modulated luminance component of the insertion frame by filtering the luminance component of the insertion frame; and a frame aligner that aligns the order of the modulated luminance components of the current and insertion frames supplied from the motion filter to obtain a driving frequency of 120 Hz and supplies the aligned data to the mixer.

14. The apparatus as in claim 13, wherein the insertion frame generator generates the insertion frame having motion between the previous frame and the current frame using the motion vectors.

15. The apparatus as in claim 13, wherein the motion filter includes:

a first motion filter that generates the modulated luminance component of the current frame by filtering the luminance component of the current frame to generate overshoot or undershoot in the boundary in accordance with the motion vectors; and a second motion filter that generates the modulated luminance component of the insertion frame by filtering the luminance component of the insertion frame to generate overshoot or undershoot in the boundary in accordance with the motion vectors.

16. The apparatus as in claim 15, wherein each motion filter generates overshoot or undershoot in the boundary to have Gaussian distribution and a height corresponding to the motion direction and the motion speed.

17. A method for driving an LCD device comprising an image display unit that includes liquid crystal cells formed in each region defined by a plurality of gate lines and a plurality of data lines, the method comprising:

detecting motion vectors from input data and generating modulated data by filtering the input data in accordance with the motion vectors to generate overshoot or undershoot in a boundary along a motion direction;

supplying scan pulses to the respective gate lines; and converting the modulated data into analog video signals to synchronize with the scan pulses and supplying the analog video signals to the respective data lines, wherein the overshoot or undershoot in the boundary has Gaussian distribution and a height corresponding to the motion direction and the motion speed, wherein the act of generating the modulated data includes generating one insertion frame using at least two adjacent frames, and generating the modulated data having a driving frequency higher than that of the data using the generated insertion frame.

18. The method as in claim 17, wherein the overshoot is generated if gray level is changed from a low gray level to a high gray level in the boundary, and the undershoot is generated if gray level is changed from a high gray level to a low gray level in the boundary.

19. The method as in claim 18, wherein the act of generating the modulated data includes:

performing inverse gamma correction on the data for the frame to generate a first data;

separating the first data into a luminance component and chrominance components;

detecting the motion vectors using the luminance component and generating a modulated luminance component by filtering the luminance component in accordance with the motion vectors;

mixing the modulated luminance component with the chrominance components to generate second data; and performing gamma correction on the second data to generate the modulated data.

20. The method as in claim 19, wherein the motion vectors include motion direction and motion speed between adjacent frames.

21. The method as in claim 20, wherein the act of generating the modulated luminance component includes:

storing the luminance component separated from the data for the frame in a memory;

detecting the motion vectors using a luminance component of a previous frame stored in the memory and a luminance component of a current frame separated from the data; and filtering the luminance component in accordance with the motion vectors to generate overshoot or undershoot in the boundary.

22. The method as in claim 21, wherein the act of generating the modulated luminance component includes:

storing the luminance component separated from the data in a memory for the unit of frame;

detecting the motion vectors using the luminance component of the current frame separated from the data and the luminance component of the previous frame stored in the memory;

generating the insertion frame having motion between the previous frame and the current frame using the motion vectors;

generating the modulated luminance component of the current frame by filtering the luminance component of the current frame in accordance with the motion vectors to generate overshoot or undershoot in the boundary;

generating the modulated luminance component of the insertion frame by filtering the luminance component of the insertion frame in accordance with the motion vectors to generate overshoot or undershoot in the boundary; and aligning the order of the modulated luminance components of the current and insertion frames to obtain a driving frequency of 120 Hz.

23. The method as in claim 22, wherein the act of filtering the luminance component of each frame includes generating overshoot or undershoot in the boundary to have Gaussian distribution and height corresponding to the motion direction and the motion speed.

24. The method as in claim 20, wherein the act of generating the modulated luminance component includes:

storing the luminance component separated from the data in a first memory for the frame;

storing the luminance component of the current frame stored in the first memory in a second memory;

detecting first motion vectors using a luminance component of a next frame separated from the data and the luminance component of the current frame stored in the first memory;

detecting second motion vectors using the luminance component of the current frame stored in the first memory and a luminance component of a previous frame stored in the second memory;

generating a comparing signal by comparing the first motion vectors with the second motion vectors;

generating the insertion frame by selecting the first and second motion vectors corresponding to the comparing signal;

generating a modulated luminance component of the next frame by filtering the luminance component of the next frame in accordance with the first motion vectors to generate overshoot or undershoot in the boundary;

generating a modulated luminance component of the current frame by filtering the luminance component of the current frame in accordance with the second motion vectors to generate overshoot or undershoot in the boundary;

generating a modulated luminance component of the insertion frame by filtering the luminance component of the insertion frame using the selected motion vectors to generate overshoot or undershoot in the boundary; and aligning the order of the modulated luminance components of the current, next and insertion frames in accordance with the comparing signal to obtain a driving frequency of 90 Hz.

25. The method as in claim 24, wherein the act of generating the insertion frame includes generating the insertion frame having motion between the previous frame and the current frame using the first motion vectors in accordance with the comparing signal if the insertion frame is inserted between the previous frame and the current frame, and generating the insertion frame having motion between the current frame and the next frame using the second motion vectors if the insertion frame is inserted between the current frame and the next frame.

26. The method as in claim 24, wherein the act of filtering the luminance component of each frame includes generating overshoot or undershoot in the boundary to have Gaussian distribution and a height corresponding to the motion direction and the motion speed.

* * * * *